US006640362B1

(12) United States Patent
Kimball

(10) Patent No.: US 6,640,362 B1
(45) Date of Patent: Nov. 4, 2003

(54) BEDDING WITH MULTIPLE OVERLAYS AND OPENINGS

(76) Inventor: Carlton H. Kimball, Rte. 27, Box 423, Belgrade Lakes, ME (US) 04918

( * ) Notice: Subject to any disclaimer, the term of this patent is extended or adjusted under 35 U.S.C. 154(b) by 0 days.

(21) Appl. No.: 10/267,652

(22) Filed: Oct. 9, 2002

(51) Int. Cl.[7] ..... A47G 9/04
(52) U.S. Cl. ..... 5/482; 5/502; 5/923; 128/854
(58) Field of Search ..... 5/482, 495–502, 5/923, 929, 486; D6/602, 603; 128/849, 853, 854

(56) References Cited

U.S. PATENT DOCUMENTS

| | | | | |
|---|---|---|---|---|
| 3,120,721 | A | | 2/1964 | Bukatman |
| 3,799,161 | A | * | 3/1974 | Collins |
| 4,021,869 | A | | 5/1977 | Root |
| 4,027,665 | A | * | 6/1977 | Scrivens |
| 4,062,076 | A | | 12/1977 | Albertson |
| 4,384,573 | A | * | 5/1983 | Elliott |
| 4,875,245 | A | | 10/1989 | Isola |
| 4,890,347 | A | | 1/1990 | Fuller |
| 5,023,969 | A | | 6/1991 | Nattras |
| D323,921 | S | | 2/1992 | Kawchak |
| 5,153,957 | A | | 10/1992 | Price, Sr. |
| 5,172,440 | A | | 12/1992 | Ming |
| 5,245,717 | A | * | 9/1993 | Rudy |
| D383,634 | S | | 9/1997 | Selph |
| 5,664,269 | A | | 9/1997 | Broder |
| D395,372 | S | | 6/1998 | Simpson |
| 5,794,285 | A | | 8/1998 | Burch |
| D411,704 | S | * | 6/1999 | Port ..... D6/602 |
| 5,943,717 | A | | 8/1999 | Alexander |
| 6,298,855 | B1 | * | 10/2001 | Baird ..... 128/849 |

* cited by examiner

*Primary Examiner*—Alexander Grosz

(57) ABSTRACT

Complimentary articles of bedding with cut-outs and removable or hinged opening overlays strategically located over the erogenous areas of bed occupants for purposes of enhancement of the sensual experience. Overlays are held in place over cut-outs or exposure openings with fasteners. Overlays attached to, or partly cloth hinged to blanket and/or sheet. Removable or partially openable at will by one or both partners as activities of an amorous nature may progress. Progressively smaller openings and overlays from top to bottom for a series of coaxially aligned openings and overlays in a mated sequence of bedding materials.

11 Claims, 3 Drawing Sheets

BEDDING WITH MULTIPLE OVERLAYS AND OPENINGS

FIELD OF THE INVENTION

The field of the present invention relates to an article of bedding. More particularly, the field of this invention relates to multiple articles of bed covering intended to enhance amorous and playful experience between lovers.

More specifically, the invention field incorporates, but is not limited to, a mated bed sheet and bed blanket. Further these articles of bedding are uniquely modified with strategically placed openings and overlays. Such overlays may be cloth hinged or completely detachable. Lastly, these items are structured for purposes of suggestive intimate enticement. Hence the adopted shorthand for my invention is "Lovers' Covers™".

EXPLANATION OF TERMS

Certain terms are used to introduce and explain the background of the art and the invention; and, for convenience and completeness sake, such terms are summarized in this section. These terms are not meant to supersede the claims nor the definition of terms as defined within the four corners of the specification, but rather, are meant to further the understanding of the invention and briefly introduce the technical art stage for a detailed teaching of the improvement in the art as provided by this invention as claimed.

Blanket

For purposes of this invention a blanket is a heavier bedding cover, and may vary in size from twin, standard up to a king size bed. When discussed herein, blanket should be considered "as modified" per the invention.

Sheet

For this invention, the sheet is the thinner lighter bedding cover and is normally positioned below the blanket. When used herein, sheet is to be considered "as modified" per the invention.

Overlay

The overlays are shaped, small coverings approximately 12 to 18 inches in general size—perhaps heart shaped, shamrock, cloverleaf or the like. There is at least one overlay per bedding item (blanket or sheet). However, there may be multiple overlays per bedding item. If used in mated pairs each blanket overlay matches a mating sheet overlay in shape, with the sheet overlay being perhaps 15% smaller than its in kind blanket overlay. These overlays may be further dressed or enhanced with lacy edging or other frills. The underneath edges are affixed with a fastener, such as light duty Velcro.

Depending on manufacture, an overlay may be attached by a cloth hinge along a short portion of the perimeter opening with the overlapping portion being added to the blanket material; or an overlay may be completely detachable.

Cut-away Exposure Opening

A cut-away exposure opening is a shaped, small open doorway, if you will, in both blanket and sheet and sized to be slightly smaller than its counterpart overlay. The larger underneath perimeter of the overlay is bordered with the hook portion of Velcro. Such Velcro border attaches to a corresponding loop portion of Velcro on the blanket (or visa versa re hooks and eyes). This loop portion on the blanket runs the perimeter of the cutout or cut-away opening

Overlay and Cut-Out Sets

Both blanket and sheet have corresponding near identical cut-out and overlay sets. These respective sets are located one above the other for "hide and seek" functionality. Each exposure opening may be in the order of about 15% smaller than its respective overlay. The sheet pair may also be about 15% smaller than the blanket pair.

Cloth Hinge

For purposes of this invention, this hinge may be simply an uncut portion of a blanket or sheet which keeps an overlay partially attached and openable from a cut-out within a blanket or sheet. Frill or decoration may be attached to the overlay both for decorative purposes and to expand the border and provide an overlap relative to the cut away portion of the correspondingly positioned opening in order to supply a fastener as described above.

BACKGROUND OF THE INVENTION

Variations in bedding, sheets and blankets are well known and take many shapes and sizes. Many are custom applications for increased warmth or ease of bed making. Typical examples are those which keep the top sheet and blanket bedding in place. Often, these use elastic or even snap attachments, for more optimum mechanical usage or placement both for decorum and for sleeping.

Beds are the primary place for rest, sleep and intimate activities between couples. There are numerous examples of stimulating "evening" wear, or lingerie sold in the marketplace. More specifically, with regard to bedding materials, satin sheets are a commonly known choice for enhancement of an amorous or "get away from it" experience. Various mattress and bedding articles provide a multi-function use for such beds.

Various lodging places—especially theme Motor Courts—have entire suites devoted to an amorous or honeymoon type stay. Young couples often look forward to such outings so that they may "escape" from the world. The invention is ideal for such theme Motor Courts or Inns in that it will provide for the users a short vacation that lets them temporarily put the work-a-day world responsibilities in abeyance. Additionally, some home decorating areas are devoted to a playful yet loving atmosphere.

Even with all the variations in bedding revealed by the prior art, none suggest or teach multiple, removable panels or overlay cutout sets built into standard size blankets and sheets for creative enticement and enhanced amorous activity. A market exists for various combinations of overlay and cut-out pairs, mated at strategic locations on standard size blankets and sheets.

DESCRIPTION OF PRIOR ART

Turning now to the prior art, a search has revealed various patents, several of which are only of peripheral relevance. Such patents include:

U.S. Pat. No. 5,153,957 to Price, Sr. (Oct. 13, 1992)

U.S. Pat. No. 5,794,285 to Burch (Aug. 18, 1998)

U.S. Pat. No. 4,021,869 to Root (May 10, 1977)

U.S. Pat. No. 5,943,717 to Alexander (Aug. 31, 1999)

U.S. Pat. No. 5,023,969 to Nattras (Jun. 18, 1991)

DES. 383,634 to Selph (Sep. 16, 1997)

U.S. Pat. No. 4,875,245 to Isola (Oct. 24, 1989)

U.S. Pat. No. 5,664,269 to Broder (Sep. 9, 1997)

U.S. Pat. No. 4,890,347 to Fuller (Jan. 2, 1990)

DES. 323,921 to Kawchak (Feb. 18, 1992)

U.S. Pat. No. 3,120,721 to Bukatman (Feb. 11, 1964)

U.S. Pat. No. 5,172,440 to Ming (Dec. 22, 1992)

DES. 395,372 to Simpson (Jun. 23, 1998)

U.S. Pat. No. 4,062,076 to Albertson (Dec. 13, 1997)

In general, these patents present pictures, folds, creases, stitching and even interchangeable logos applied to top coverings, blankets, sheets and the like in various configurations with either of two goals in mind—holding bedding in place, or, creating an aesthetically pleasing appearance.

While several of the patents such as Price, Sr. and Burch do include the use of Velcro and various folds, etc., they are not significantly relevant to my invention of intimacy enhancement combined with panels for partner access.

Most of the above art is only peripherally relevant having to do with pure bedding items for sleep, warmth, or decorative coverings for beds when not in use. However, I will now briefly address each patent and demonstrate the difference between the art and the invention.

U.S. Pat. No. 5,153,957 to Price, Sr. (Oct. 13, 1992)

Bedding. This art discloses a fitted bedspread assembly with velcro attachments and special folds. Its purpose is to keep a neat—in place—covering in tight bedding confines, such as the sleeper of a tractor trailer.

U.S. Pat. No. 5,794,285 to Burch (Aug. 18, 1998)

Bedding. This patent shows a variation on fitted sheets. There is an extra sheet between the mattress and box springs which is larger in periphery with Velcro attachments to mate with velcro top sheets and/or blankets.

U.S. Pat. No. 4,021,869 to Root (May 10, 1977)

Bedding. This is a fitted sheet or blanket which has an additional folded pocket toward the bottom that provides extra foot room volume.

U.S. Pat. No. 5,943,717 to Alexander (Aug. 31, 1999)

Bedding. This can best be described as two double bed overlapping blankets used on a king size bed. These two narrower blankets are stitched together at the bottom. The objective is to presumably make it easier to get out of bed without disturbing a bed partner. No Velcro is used. There are no special openings.

U.S. Pat. No. 5,023,969 to Nattras (Jun. 18, 1991)

Bedding. This is another variation of a split blanket. In this case, there is an extra flap for each person, so that one may be more easily uncovered or covered per each person's temperature needs.

U.S. patent DES. 383,634 to Selph (Sep. 16, 1997)

Pillow and blanket bedding. Selph does not appear to be relevant even in appearance. His goal appears to be an attached blanket and pillow combination.

U.S. Pat. No. 4,875,245 to Isola (Oct. 24, 1989)

Decorative Illustration. This is a bed covering similar to Broder, in which top bedding including a pillow case flipped/and changed end for end, to show a different continuous scene. The complete scene is the result of the combination of the pillow case, the top one third of a bottom sheet, and the top one third of a top sheet which has been folded back to an exactly matching scene.

U.S. Pat. No. 5,664,269 to Broder (Sep. 9, 1997)

Decorative Illustration. Theme similar to Isola. This disclosure reveals a bed covering with extra "halves" sewn exactly across the center. By laying one half upward, a full pattern of a first kind shows, by laying a half downward, another full pattern shows. Another "half" is identically stitched across the bottom of the covering. Thus, up to four "scenes" can be used with essentially one blanket. Halves are snapped in place at the top and/or bottom.

DES. 323,921 to Kawchak (Feb. 18, 1992)

Decorative Illustration. Younger children. This disclosure is similar to Ming and Fuller but without the storage. More specifically it is a sleeping bag re-shaped in the form of a slice of pizza, crust being the pillow. Removable Velcro appliques of pepperoni and mushrooms, and the like, are in 3-D on top.

Although the applique shapes are apparently removable, they do not teach or suggest access openings under such shapes. This patent—essentially attached appliques—is a disclosure that is similar to Fuller. In fact, the concept of a sleeping bag itself would lead one away from my inventive removable shapes, with multiple openings.

U.S. Pat. No. 4,890,347 to Fuller (Jan. 2, 1990)

This Patent discloses a top covering design with large velcro appliques. These appliques may have voids underneath for storage. Like the pizza slice appliques, they are more 3-D.

Fuller, like others, does use Velcro to attach changeable appliques to bedspreads or top comforters for simple decorative usage. Fuller is of only peripheral relevance as the appliques are velcro attached for ease of removal for washing, dry cleaning, and the like. Again, there is no teaching of multiple layers or openings, and certainly nothing on strategic access through multiple overlays.

The Fuller and Kawchak patents are essentially adaptations from one another.

U.S. Pat. No. 5,172,440 to Ming (Dec. 22, 1992)

Toy pattern and storage. Children. This is for the most part, a series of different designs within a utility Patent setting. Each design is really only a loose storage bag that receives the other parts of floor bedding such as a child's bulky sleeping bag. The manner in which the design parts of the bag are stitched, lets the design "show" (such as an animal's head) when the bedding has been folded and zipped inside.

U.S. Pat. No. 3,120,721 to Bukatman (Feb. 11, 1964)

This Patent reveals a child's bedspread in an automotive motif. Automotive-related appliques may be snap fastened to parts of a bedspread, such as a small steering wheel and back rest against the headboard.

DES. 395,372 to Simpson (Jun. 23, 1998)

Covering. Heart shape cut out car blanket. While Simpson shows a heart-shaped cut-out located for the users head in a car blanket, he does not teach nor suggest removable coverings in multiple openings designed and positioned for stimulating usages. The opening for one's head is in fact, very similar to the opening in a typical poncho. Although a flap is shown, the intended purpose with respect to a user is unclear. Likewise, there is no teaching of multiple, overlaid blanket and sheet arrangements with fitted, vertically aligned cut-outs.

U.S. Pat. No. 4,062,076 to Albertson (Dec. 13, 1997)

Bedding. Design. Blanket with slits. Albertson, on the other hand, does present a single blanket with slits through which a user may extend hands and wrists. A bedtime reader is provided a means of holding a book, while still keeping arms and shoulders covered and warm.

This Patent discloses a blanket having two slits cut at the proper location to allow a person to read in bed with their arms still covered. There is also a design aspect in that the slits may be cut, curved and decorated with eyelashes. In Albertson there are no coverings nor overlays for access. Furthermore, his intended usage was not advantageous for intimacy.

In contrast to the mostly decorative nature of the prior art, my invention here presented, for the first time, is a novel combination of bedding—singular or in sets—which easily lends itself to creative access variations between couples for playful sexual enhancement. The overlay-covered openings provide airway passages from within and access from without. Multiple layers, hinged or removable, at strategically located erogenous positions provides intimacy without a need for one or both undressed partners to be completely uncovered in air conditioned rooms and/or colder climate areas.

SUMMARY OF THE INVENTION

Briefly summarized, my Lover's Covers™ in one embodiment includes a mated top blanket and a corresponding underneath sheet. Each of the mated coverings have strategically located exposure openings. Further, each opening is covered by overlays of theme suggestive design, color and/or material type. Further, these openings are of differing sizes with the inner or lower placed sheet opening being generally under the opening in the top blanket but smaller in size, though similarly patterned. The perimeters of each exposure opening and overlay are fitted for access by a mated fastening means such as a zipper, Velcro or the like.

In a typical scenario the lovers covers of my invention will present a decorative outward appearance to one entering a bed room. Usage of the invention, generally involves coyly releasing the fastener. Such release may involve one or more layers of bedding at the user's option. If all layers are aside visually suggestive areas of the bedded ones' body and/or lingerie may be accessible through the open doorways formed by an overlay cut out set. In the course of activity from under the covers, such overlays and access provide passages allowing one to "come up for air", while at the same time avoiding cold room exposure to undressed users.

OBJECTS OF THE INVENTION

It is an object of the invention to provide bedding material with stimulating and suggestive designs which may aid sensual activities.

It is an object of the invention to a provide at least one or more layers of bedding (top blanket(s) and sheet(s)) with matching suggestive designs, for example heart shaped designs with lace surrounds.

It is an object to create such suggestive designs in the form of removable overlays that present to a non bedded one a pleasing visual appearance, yet allow easy in or out access as an option without removing the covers.

It is an object of the invention to use a sensually pleasing material such as satin for such suggestive overlays.

It is an object of the invention to provide a smaller accessible design on the bottom sheet than the top blanket to facilitate opening, alignment and/or removal.

It is an object to provide a cloth hinge so as to provide a means of folding back an overlay and create a visual stimulus.

It is an object to provide securing means to an opening and an overlay on a sheet or blanket in the form of small pieces of velcro sewn respectively to the underside of the overlay and upper side of the cover.

It is an object of the invention to cut an opening in a top blanket and matching sheet such that a portion of the overlay perimeter remains uncut, and thus the uncut portion serves as a hinge.

It is an object to provide a completely removable cut-out and overlay for purposes of ease of manufacture.

It is an object to incorporate the accessible cut-outs and overlays on all sizes of bedding material—king, queen, twin, standard, etc.

It is an object, for a single overlay application, to place such overlays about thirty-two inches from the bottom edge of the bed to the center of the overlay and centered crosswise between the edges of the bed.

It is an object, for a dual application overlay—measured relative to the center of the overlays—to place one set of overlays about twenty four inches from one side edge of the bed and twenty four inches up from the bottom of the bed; and, twenty four inches in from the other side edge and forty eight inches up from the bottom edge of the bed.

It is an object to provide a completely removable cut-out and overlay for the purpose of dry cleaning or laundering.

DESCRIPTION OF EMBODIMENT(S)

Figure 1:
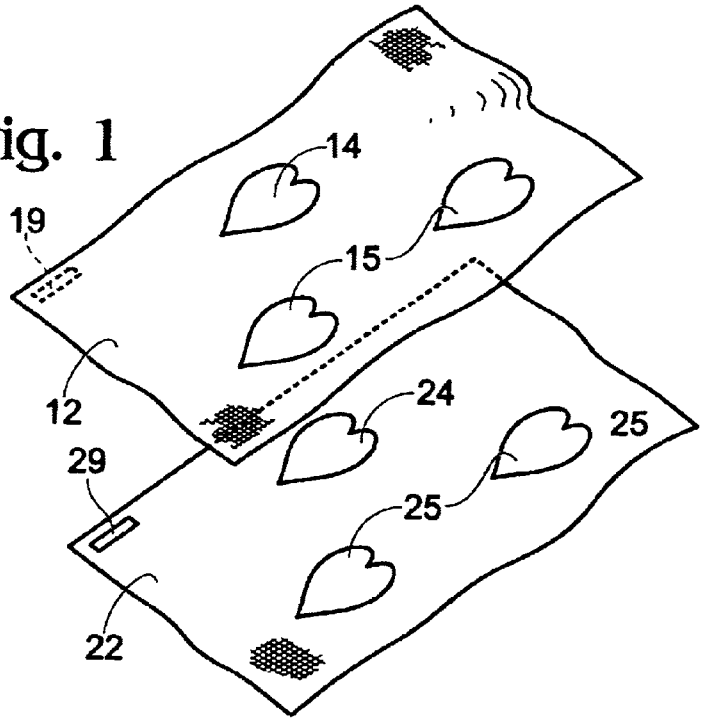
FIG. 1 presents a top or plan view with cut-away and overlays, showing the proximate locations of cover inserts of the invention.

Turning now to my preferred embodiment shown in FIG. 1, my Lover's Covers invention is built around, and within a blanket 12 and a sheet 22. Blanket 12 and sheet 22 may be twin, double, king, queen-size or standard-size bedding, blankets, and sheets. Such covering, in mated sets, employ some elasticized or snapped edge seams areas to serve as fastening devices in order to hold them generally aligned when loosely covering occupants in a bed (not shown).

Figure 3:
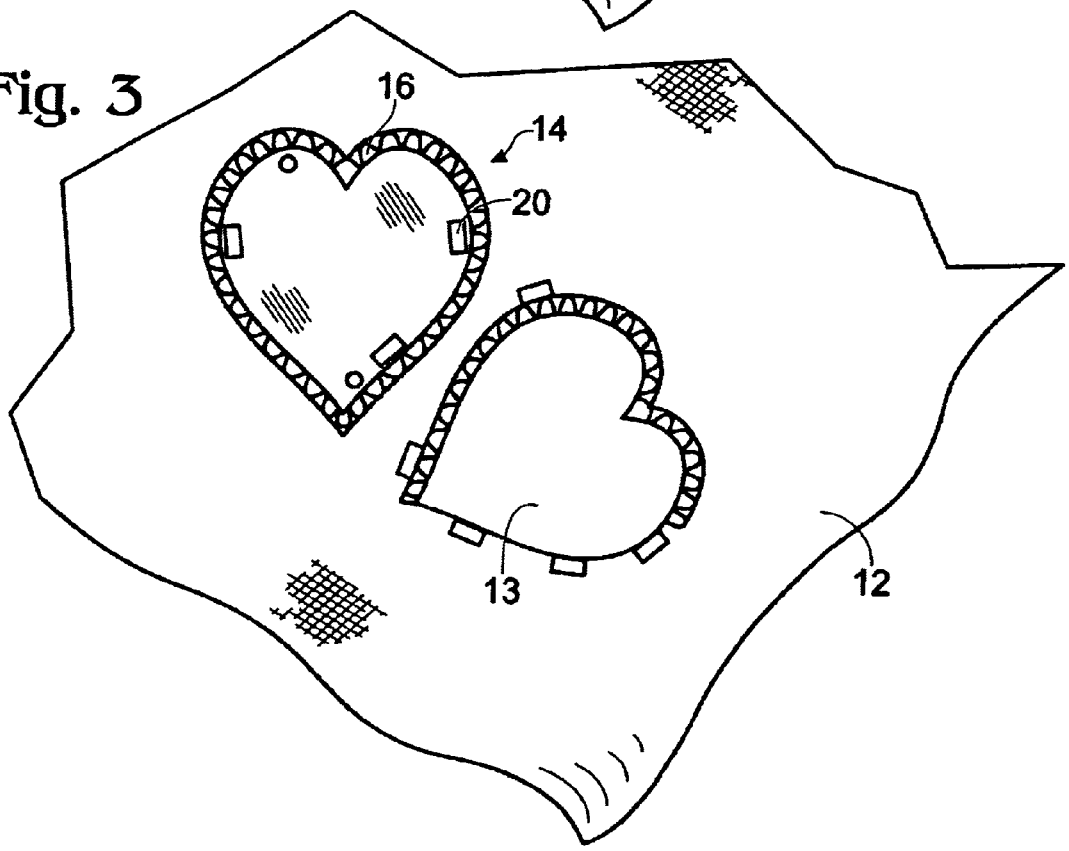
FIG. 3 presents a completely detachable overlay.
Figure 4:
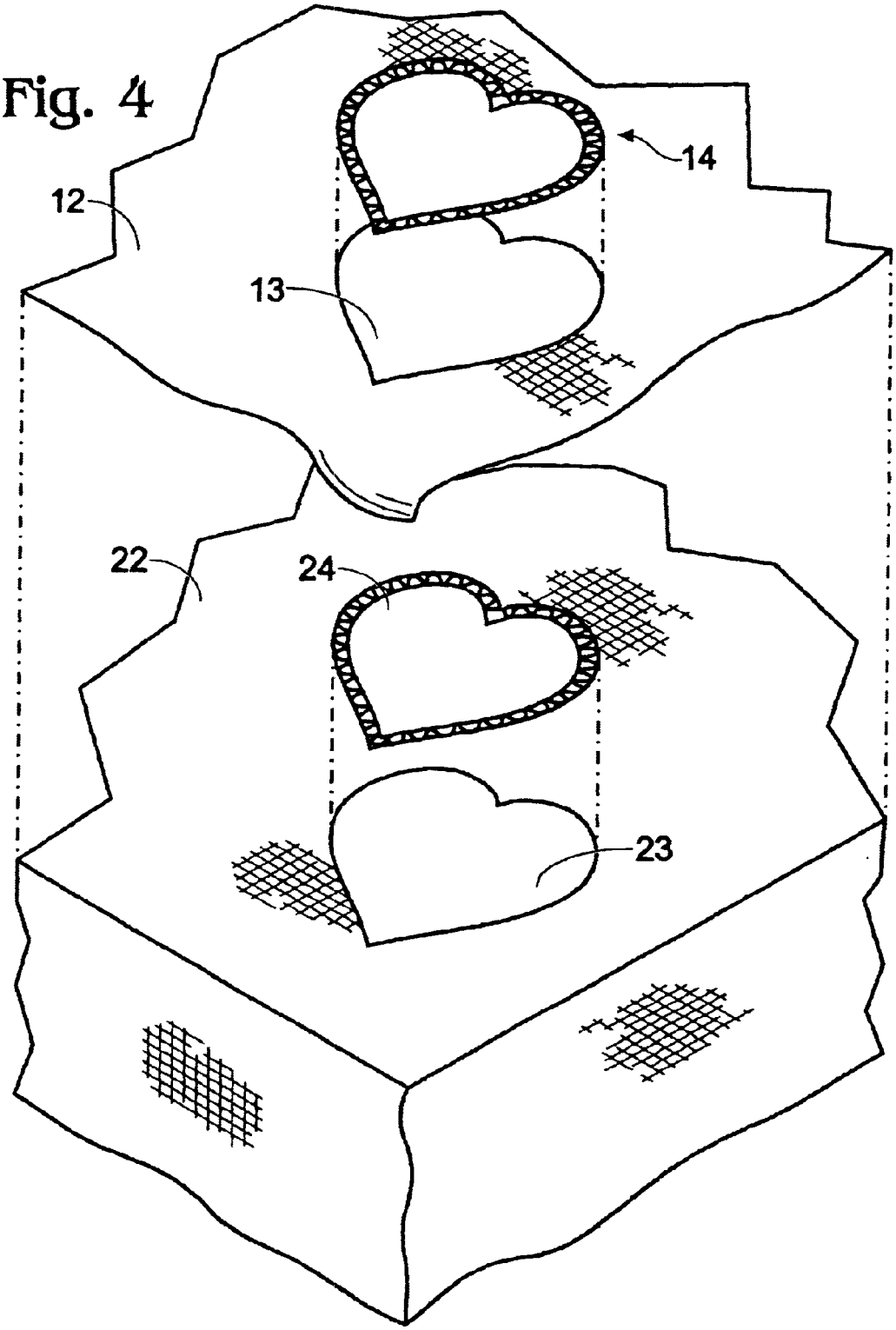
FIG. 4 presents an exploded view of overlays and openings demonstrating function and relative size.

Blanket 12 and sheet 22 are further constructed with shaped overlay designs 14 and 24 respectively. Such overlays designs, as developed further in FIGS. 3 and 4, are openable and/or removable. Designs 14 and 24 may be singular or multiple as shown in FIG. 1 and FIG. 4.

Figure 1A:
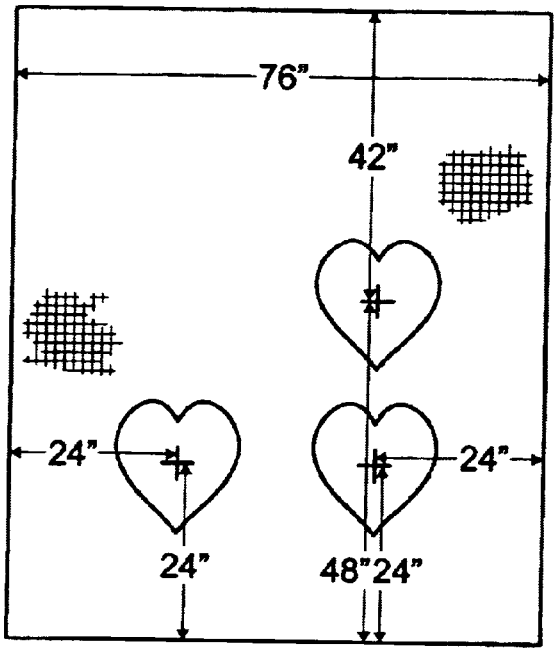
FIGS. 1A and 1B present top views of overlays arranged on coverings, in various locations
Figure 1B:
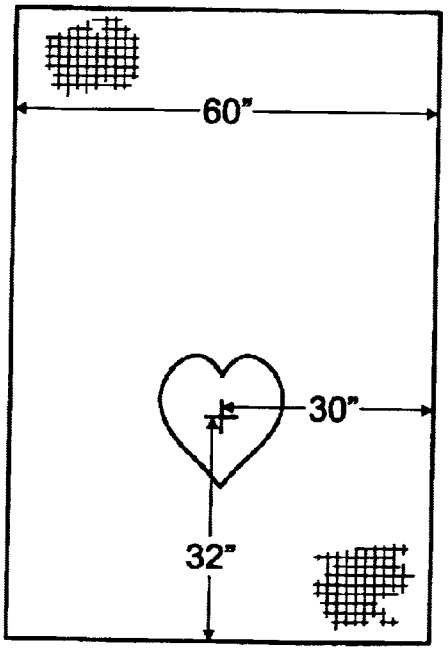

Designs 14 and 24 are positioned top to bottom for a single, on the order of 32 inches from the bottom, and from 24 to 30 inches from the side edge, FIG. 1A, FIG. 1B. Whereas designs 15 and 25, FIG. 1, are shown on blanket 12 and sheet 22 with approximate dimensions of 24 inches in from the side and 24 inches from the bottom on one bed side for a man, and 24 inches from the edge and 48 inches upward from the bottom in keeping with the appropriate distances for a woman's enticement zones.

As an additional feature, blanket 12 and sheet 22 may be additionally configured with small strips of Velcro 19 and 29 at corners and sides, FIG. 1, as appropriate. Such Velcro pairs 19 and 29 may aid in maintaining blanket 12 and sheet 22 positionally square with each other, thereby also keeping overlay pairs better aligned with each other. This may be particularly helpful, for example, in the case of a satin sheet.

Figure 2:
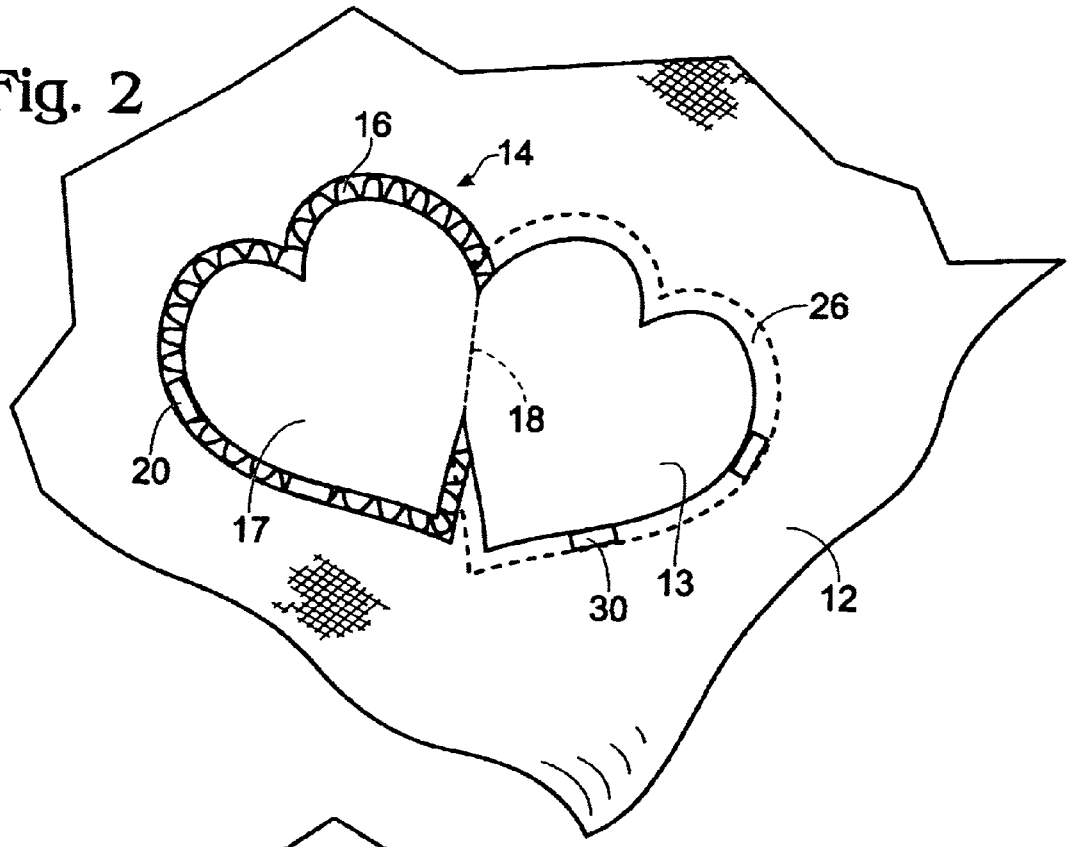
FIG. 2 is a perspective view showing the top blanket insert folded back to expose a lower covering.

Moving now to FIG. 2, in a preferred embodiment, top blanket 12 is shown with design, or overlay 14, opened to the left. This opening configuration is typical of both blanket 12 and sheet 22. Notice that overlay 14 is enlarged in perimeter with lace 16. Such an enlargement 16 creates the necessary overlap for fastening via Velcro 20.

Returning to blanket 12, notice that an exposure opening 13 has been cut through the fabric. Opening or cut-out 13 is partial and creates a hinged material flap 18. Likewise the combination of opening 13, flap 17 and cloth hinge 18 covers an erogenous zone of a user. Thus, overlay 14 is comprised of blanket flap 17, expanded lace perimeter 16, and a spaced few, or a continous encircling, of attachment Velcro pieces 20.

When hinge 18 closes, overlay 14 is positioned to cover opening 13 and upper Velcro 20 mates with lower Velcro 30 when in an overlapped position. Opening or closing of the heart shaped design may be done at the whim of either or both partners and may be done from within or without the bed.

Although rectangular strips of Velcro 20 are shown, these may be simply round velcro dots instead. The amount of Velcro used would of course determine the resistance and may vary from design to design. In certain instances, the objective may be to have the overlays very loosely fitted, whereas certain cold-climate options may call for a tighter attachment.

In a typical usage scenario, a partner may be briefly out of the bedroom. The other partner may reach out from under the covers and carefully lay back the top blanket overlay 14 exposing the lower sheet overlay 24. Additionally, sheet overlay 24, on impulse of a partner, may also be completely or partially folded open, signaling wishes and intentions.

Thus positioned, one lover may be "napping" or pretending so, whereas the partner may then enter the room. With expectation, the partner may thus lift sheet overlay 24 exposing to touch, the other lover. She may have chosen to appropriately position herself strategically under opening 23 under overlay 24, FIG. 4.

Additionally the lower sheet overlay 24 could be a differing color, shade, or decoration. As such, a more subtle signal may be visually given. Alternatively, a physical signal might be given with touch—the partner feeling that overlay 14 has been opened. At this point, one may focus on the sheet overlay 24.

Turning now to FIG. 3, an alternative embodiment is shown. This embodiment is comprised of a fully detachable overlay 14 and a full cut-out 13 in blanket 12. Overlay 14 is a completely detachable entity, made up of a base structure heart shaped material, bordered on the underneath side with Velcro 20 and dimensionally enlarged with optional lace trim 16. Overlay 14 is continuously larger in perimeter than cut-out 13. Although shown only on blanket 12, the same exact shape and structure may readily be provided for sheet 22. Either or both 13, 14 may have lace surrounds.

Turning now to FIG. 4, an exploded view presentation of blanket 12 and sheet 22 overlays and openings is shown. Notice that from top to bottom, overlay 14 is larger than blanket opening 13, perhaps on the order of 15%. Likewise overlay 24 in sheet 22 is smaller than opening 13 in blanket 12. In like fashion, cut-out 23 is smaller than overlay 24 in sheet 22. Such sequential step down in size facilitates removal of sheet coverings through overlay accesses and blanket coverings.

Thus, my invention is a novel blanket and sheet configuration that leaves a partner's erogenous areas covered or uncovered for suggestive enticement as each and/or both partners may desire.

What is claimed is:

1. Theme related non-restraining bed covering of generally rectangular configuration positionally suggestive of concealed yet easy access to the erogenous zone of bed occupant(s) under loosely draped coverings such as a top blanket and a corresponding underneath sheet for covering a majority of the bed occupant(s) thereunder, the covering improvement comprising:

generally rectangular top and underneath coverings;

means for essentially aligning the top and underneath coverings such that these generally rectangular bed coverings remain coaxially aligned with each other when draped over bed occupant(s);

exposure openings in both of said coverings positioned generally over the erogenous zones of a male, female or both occupant(s) of a bed;

a decorative overlay of predetermined design, color and/or material covering each exposure opening and concealing same from an out-of-bed view of said coverings; and each overlay and exposure opening having a perimeter that is fitted with opposed fastening means for user access from under the covers or outside thereof to reveal the zones thereunder at the will of the occupants.

2. Bed covering of claim 1 wherein said openings further comprise:

a smaller accessible design on the underneath covering that the top covering to facilitate opening and or removal.

3. Bed covering of claim 1 wherein said overlays further comprise:

a cloth hinge means fastening the overlay to the upper surface of said covering to allow a folding back of the overlay in order to create visual stimulus.

4. Bed covering of claim 1 wherein said opposed fastening means further comprises:

small pieces of opposed hook and eyes sewn respectively to the underside of the overlay and the upper side of the coverings.

5. Bed covering of claim 1 wherein said opposed fastening means further comprises:

a majority of the perimeter of a matched opening and overlay respectively affixed with attachment means.

6. Bed covering of claim 1 and further comprising:

said overlay is completely removable from said coverings.

7. Bed covering of claim 1 and further comprising:

each cutout and overlay are approximately 12 to 18 inches in general size and are heart shaped.

8. Bed covering of claim 1 and further comprising:

at least one overlay and cutout per covering, wherein each overlay and cutout matches a mating covering overlay in shape, with the underneath covering overlay being about 15% smaller than its in kind top cover overlay.

9. Bed covering of claim 1 and further comprising:

each overlay is further enhanced with lacy edging affixed thereto.

10. Bed covering of claim 1 and further comprising:

an overlay being cloth hinge attached along a short portion of an opening perimeter with the overlapping portion being added to the covering material.

11. Theme related non-restraining bed covering of generally rectangular configuration positionally suggestive of concealed yet easy access to the erogenous zone of bed occupant(s) under loosely draped coverings such as a top blanket and a corresponding underneath sheet for covering a majority of the bed occupant(s) thereunder, the covering improvement comprising:

overlapping fastening means for essentially aligning the top and underneath coverings such that these generally rectangular bed coverings remain coaxially aligned with each other when draped over bed occupant(s);

exposure openings in both of said bed coverings positioned generally over the erogenous zones of a male, female or both occupant(s) of a bed;

at least one decorative overlay of predetermined design, color and/or material covering each exposure opening and concealing same from an out-of-bed view of said coverings;

each overlay and exposure opening having a perimeter that is fitted with opposed fastening means for user access from under the covers or outside thereof to reveal the zones thereunder at the will of the bed occupants;

a smaller accessible design on the bottom covering than the top covering to facilitate opening and or removal of overlay/opening sets in said coverings;

second means fastening each overlay to the upper surface of said coverings to allow a folding back of the overlay in order to create visual stimulus;

said second fastening means further comprising small pieces of opposed hook and eyes sewn respectively to the underside of the overlay and the upper side of the covering; and each cutout and overlay are approximately 12 to 18 inches in general size and are heart shaped with each overlay being further enhanced by lacy edging affixed thereto.

* * * * *